US009279397B2

(12) United States Patent
Werner et al.

(10) Patent No.: US 9,279,397 B2
(45) Date of Patent: Mar. 8, 2016

(54) SYSTEM AND METHODS FOR CANISTER PURGING WITH LOW MANIFOLD VACUUM

(71) Applicant: Ford Global Technologies, LLC, Dearborn, MI (US)

(72) Inventors: Matthew Werner, Marysville, MI (US); Scott A. Bohr, Novi, MI (US); Russell Randall Pearce, Ann Arbor, MI (US); Andrew M. Gitlin, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 183 days.

(21) Appl. No.: 14/069,191

(22) Filed: Oct. 31, 2013

(65) Prior Publication Data

US 2015/0114360 A1 Apr. 30, 2015

(51) Int. Cl.

| | |
|---|---|
| ***F02M 33/02*** | (2006.01) |
| ***F02M 25/08*** | (2006.01) |
| ***F02D 41/00*** | (2006.01) |
| *F02D 29/02* | (2006.01) |

(52) U.S. Cl.

CPC ..... *F02M 25/0836* (2013.01); *F02D 41/0032* (2013.01); *F02M 25/089* (2013.01); *F02D 29/02* (2013.01); *F02D 2200/0406* (2013.01)

(58) Field of Classification Search

CPC . F02M 25/0836; F02M 25/089; F02M 25/08; F02D 41/004; F02D 41/003; F02D 41/0032; F02D 41/062

See application file for complete search history.

(56) References Cited

U.S. PATENT DOCUMENTS

| | | | | |
|---|---|---|---|---|
| 3,886,920 | A * | 6/1975 | Van Dusen, III | F02M 25/089 123/179.16 |
| 3,937,198 | A * | 2/1976 | Sudhir | F02M 25/0836 123/519 |
| 5,080,078 | A * | 1/1992 | Hamburg | F02M 25/0836 123/519 |
| 5,245,973 | A * | 9/1993 | Otsuka et al. | 123/518 |
| 5,601,065 | A * | 2/1997 | Tamura et al. | 123/516 |
| 5,617,832 | A * | 4/1997 | Yamazaki et al. | 123/520 |
| 6,014,958 | A * | 1/2000 | Miwa et al. | 123/520 |
| 6,189,515 | B1 | 2/2001 | Jamrog et al. | |
| 6,269,803 | B1 * | 8/2001 | Corkill | F02M 25/0809 123/520 |
| 6,446,614 | B1 * | 9/2002 | Matsuoka et al. | 123/516 |
| 7,284,541 | B1 | 10/2007 | Uchida | |
| 7,311,089 | B2 | 12/2007 | Balsdon | |
| 7,373,930 | B1 * | 5/2008 | Hadre | 123/520 |
| 7,591,252 | B1 * | 9/2009 | Park | 123/520 |

(Continued)

OTHER PUBLICATIONS

Takagai, N. et al., "Development of Exhaust and Evaporative Emissions Systems for Toyota THS II Plug-in Hypbrid Electric Vehicle," SAE International Paper Journal Fuels Lubr. 3(1):406-413, 2010, 7 pages.

*Primary Examiner* — Lindsay Low
*Assistant Examiner* — Tea Holbrook
(74) *Attorney, Agent, or Firm* — James Dottavio; Alleman Hall McCoy Russell & Tuttle LLP

(57) ABSTRACT

A method for purging fuel vapors, comprising: purging fuel tank vapors directly from a fuel tank to an engine intake, bypassing a canister, via a venturi, while drawing canister vapors via the venturi into the purged fuel tank vapors en route to the engine intake. In this way, fuel tank vapors may be used to enable purging of a fuel vapor canister, even under conditions where there is insufficient manifold vacuum to enable a canister purge routine. By increasing the frequency of purge opportunities, bleed emissions from a saturated canister may be reduced.

16 Claims, 4 Drawing Sheets

(56) References Cited

U.S. PATENT DOCUMENTS

| | | | | |
|---|---|---|---|---|
| 7,966,996 | B1 * | 6/2011 | Pursifull | F02B 37/127 123/198 C |
| 8,483,934 | B2 | 7/2013 | Cunningham et al. | |
| 8,967,122 | B2 * | 3/2015 | Miyata et al. | 123/520 |
| 2005/0016505 | A1 * | 1/2005 | Everingham et al. | 123/520 |
| 2005/0178368 | A1 * | 8/2005 | Donahue | F02M 35/10222 123/520 |
| 2007/0227514 | A1 * | 10/2007 | Terada | 123/519 |
| 2009/0007890 | A1 * | 1/2009 | Devries et al. | 123/520 |
| 2010/0012099 | A1 * | 1/2010 | Kerns | F02D 41/0042 123/520 |
| 2011/0146631 | A1 * | 6/2011 | Konohara et al. | 123/520 |
| 2011/0308493 | A1 * | 12/2011 | Mitchell | 123/196 R |
| 2012/0247432 | A1 * | 10/2012 | Cardno | 123/518 |
| 2012/0318244 | A1 * | 12/2012 | Williams | 123/520 |
| 2013/0263590 | A1 | 10/2013 | Kempf et al. | |
| 2013/0269660 | A1 * | 10/2013 | Peters et al. | 123/520 |
| 2014/0123962 | A1 * | 5/2014 | Ide | F02M 25/089 123/520 |
| 2014/0174573 | A1 * | 6/2014 | Matsunaga et al. | 137/565.23 |
| 2015/0114361 | A1 * | 4/2015 | Matsunaga et al. | 123/520 |

* cited by examiner

SYSTEM AND METHODS FOR CANISTER PURGING WITH LOW MANIFOLD VACUUM

BACKGROUND AND SUMMARY

Vehicle emission control systems may be configured to store fuel vapors from fuel tank refueling and diurnal engine operations in a fuel vapor canister, and then purge the stored vapors during a subsequent engine operation. The stored vapors may be routed to engine intake for combustion, further improving fuel economy.

In a typical canister purge operation, a canister purge valve coupled between the engine intake and the fuel canister is opened, allowing for intake manifold vacuum to be applied to the fuel canister. Simultaneously, a canister vent valve coupled between the fuel canister and atmosphere is opened, allowing for fresh air to enter the canister. This configuration facilitates desorption of stored fuel vapors from the adsorbent material in the canister, regenerating the adsorbent material for further fuel vapor adsorption.

However, current and future engine systems may be configured to operate under relatively low manifold vacuum conditions. While this may increase engine efficiency, it also reduces the opportunities for fuel vapor canister purging. This may particularly apply to hybrid vehicles, which have a limited engine run time to begin with. As such, stored vapors may be prone to desorption during diurnal cycles, increasing vehicle emissions and failing to comply with government regulations.

The inventors herein have realized the above issues and have developed systems and methods to at least partially address these issues. In one example, a method for purging fuel vapors, comprising: purging fuel tank vapors directly from a fuel tank to an engine intake, bypassing a canister, via a venturi, while drawing canister vapors via the venturi into the purged fuel tank vapors en route to the engine intake. In this way, fuel tank vapors may be used to enable purging of a fuel vapor canister, even under conditions where there is insufficient manifold vacuum to enable a canister purge routine. By increasing the frequency of purge opportunities, bleed emissions from a saturated canister may be reduced.

In another example, a system for an evaporative emissions system, comprising: a fuel tank coupled to a fuel vapor canister via a first fuel tank isolation valve; an ejector coupled to the fuel vapor canister and a second fuel tank isolation valve, the second fuel tank isolation valve configured to: responsive to a fuel tank pressure being above a threshold, enable fuel vapor to flow from the fuel tank through the ejector to an engine intake; and draw a vacuum on the fuel vapor canister. In this way, the system leverages fuel tank vapor pressure, which currently has no benefits, into generating a vacuum applied to a fuel vapor canister. The vacuum generated by venting fuel tank vapor through the ejector does not add any additional load on the engine.

In yet another example, a method for purging a fuel vapor canister, comprising: during a first condition including a fuel tank pressure above a threshold, close a first fuel tank isolation valve, the first fuel tank isolation valve coupled between a fuel tank and a fuel vapor canister; open a second fuel tank isolation valve, the second fuel tank isolation valve coupled between the fuel tank, the fuel vapor canister, and an engine intake; and open a canister purge valve and canister vent valve. In this way, fuel tank vapors may be purged directly to intake under some conditions, while drawing manifold vacuum is not required to purge the fuel vapor canister. This may lead to an increase in engine efficiency, as a high intake vacuum is not required to purge the fuel vapor canister in order to comply with government regulations for evaporative emissions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

DETAILED DESCRIPTION

Figure 1:
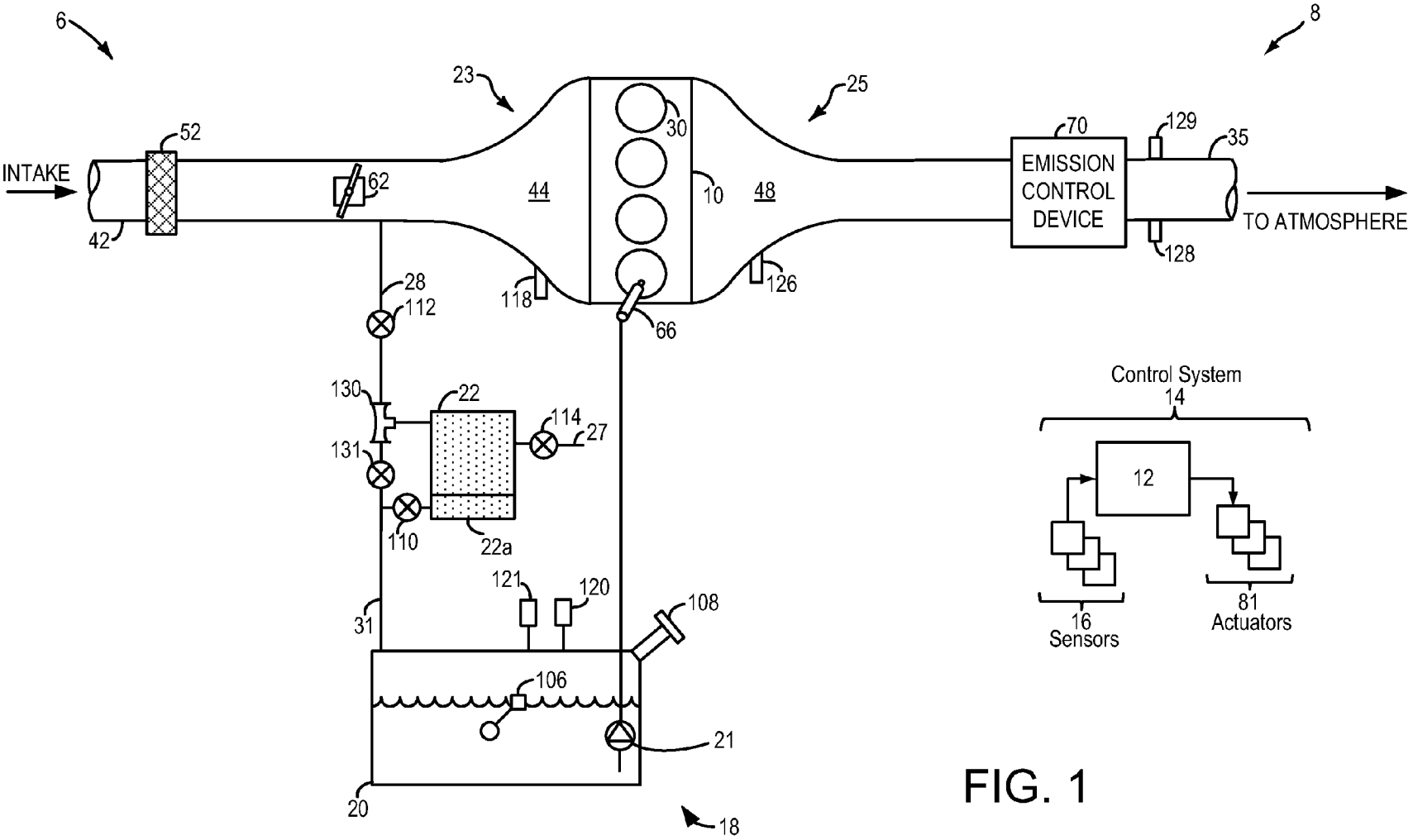
FIG. 1 shows a schematic depiction of a fuel system coupled to an engine system.
Figure 2B:
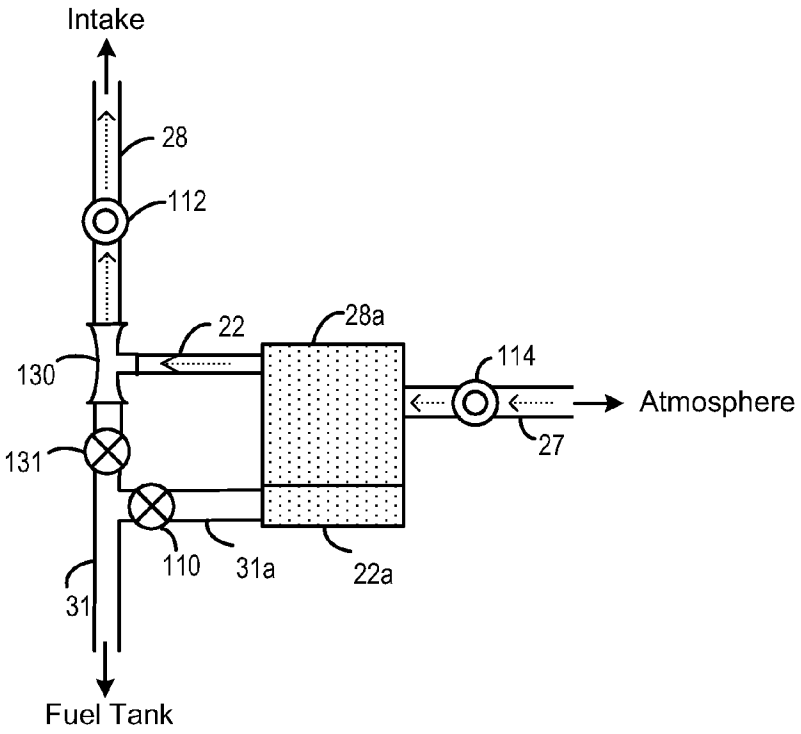
FIG. 2B shows a detailed schematic depiction of a portion of a fuel system in a second configuration.
Figure 2A:
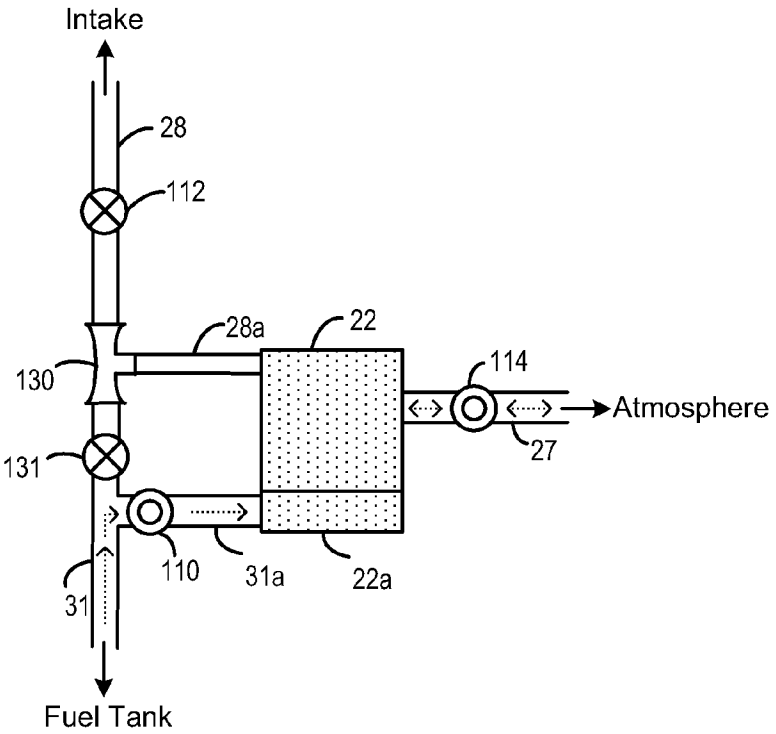
FIG. 2A shows a detailed schematic depiction of a portion of a fuel system in a first configuration.
Figure 2C:
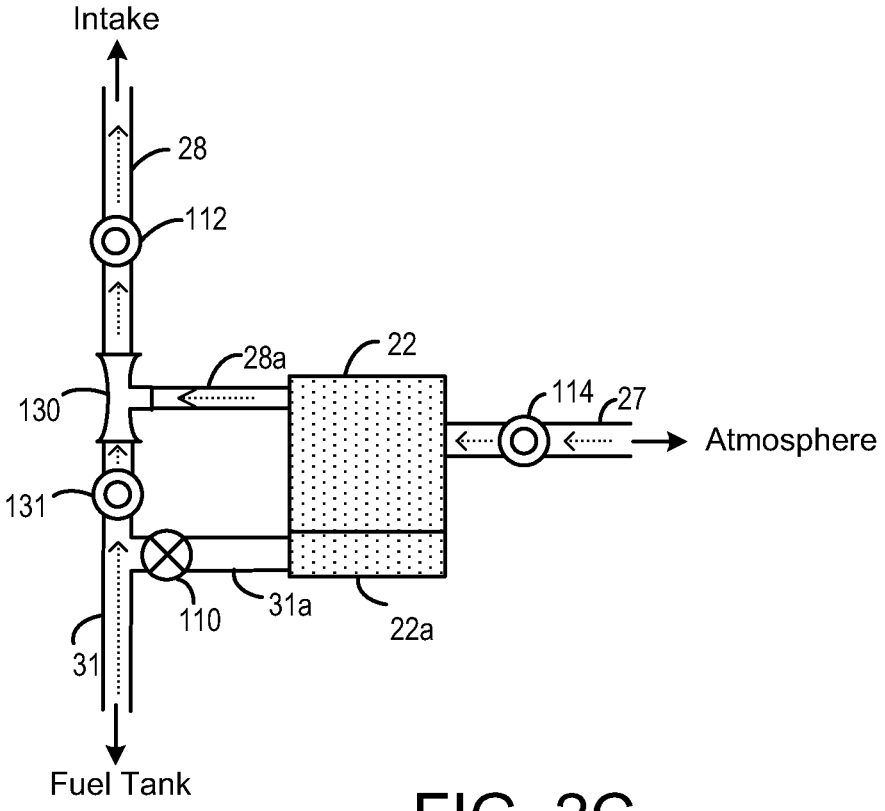
FIG. 2C shows a detailed schematic depiction of a portion of a fuel system in a third configuration.
Figure 3:
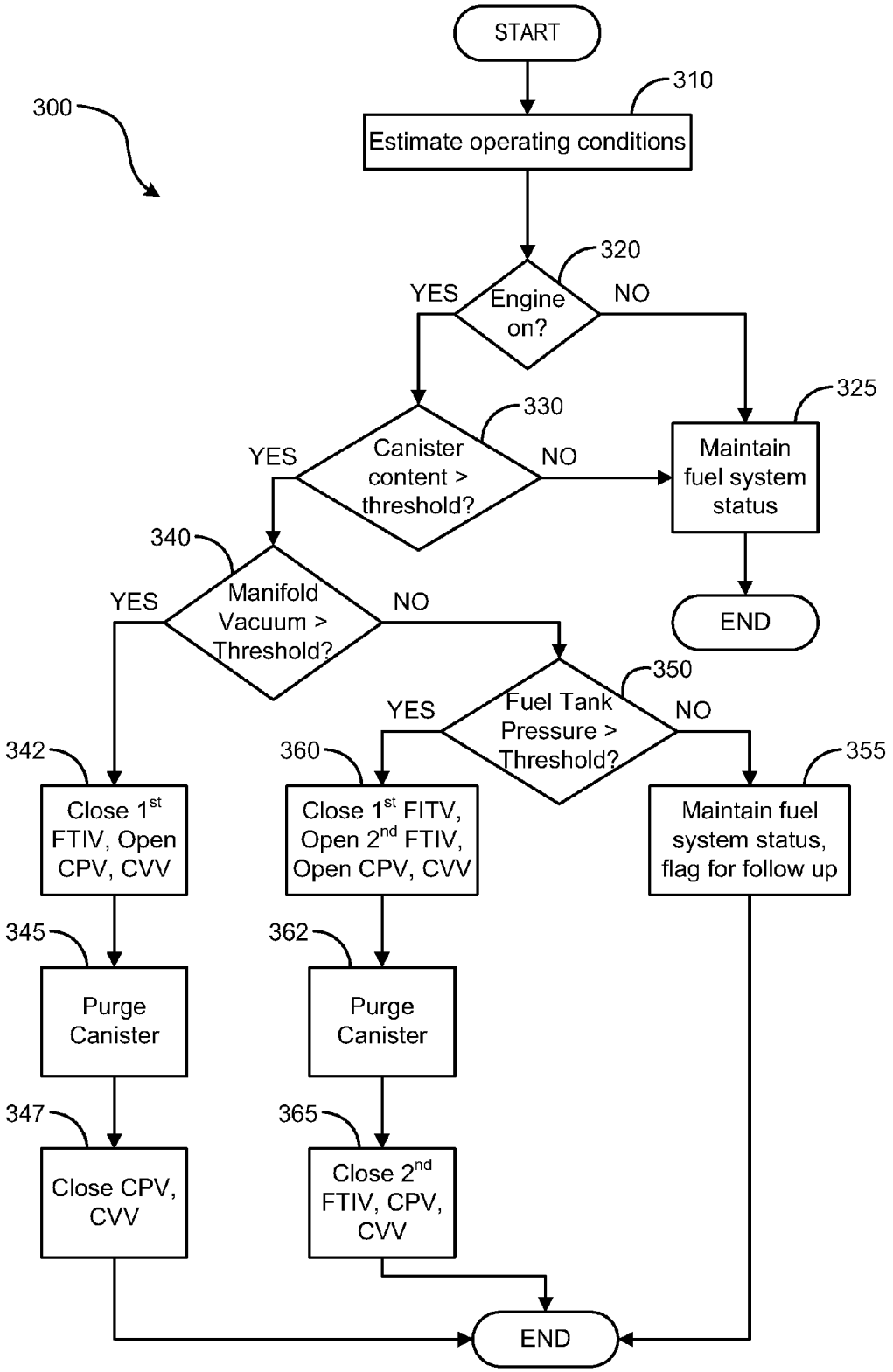
FIG. 3 shows a flow chart for a high level method for purging a fuel vapor canister in accordance with the current disclosure.

This disclosure relates to systems and methods for managing fuel vapor in a fuel system coupled to an engine, such as the fuel system and engine depicted in FIG. 1. Specifically, the disclosure relates to systems and methods for purging a fuel vapor canister under conditions where low manifold vacuum is available. As shown in FIGS. 2A-2C, a fuel system may incorporate first and second fuel tank isolation valves as well as an ejector for facilitating canister purging based on fuel tank vapor pressure. An example method for purging a fuel canister using the systems of FIGS. 1 and 2 is depicted in FIG. 3.

FIG. 1 shows a schematic depiction of a hybrid vehicle system 6 that can derive propulsion power from engine system 8 and/or an on-board energy storage device, such as a battery system. An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. During a fuel tank refueling event, fuel may be pumped into the vehicle from an external source through refueling port 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. While a single canister 22 is shown, it will be appreciated that fuel system 18 may include any number of canisters. In one example, canister purge valve 112 may be a solenoid valve wherein opening or closing of the valve is performed via actuation of a canister purge solenoid.

Canister 22 may include a buffer 22*a* (or buffer region), each of the canister and the buffer comprising the adsorbent. As shown, the volume of buffer 22*a* may be smaller than (e.g., a fraction of) the volume of canister 22. The adsorbent in the buffer 22*a* may be same as, or different from, the adsorbent in the canister (e.g., both may include charcoal). Buffer 22*a* may be positioned within canister 22 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 114 may be a solenoid valve wherein opening or closing of the valve is performed via actuation of a canister vent solenoid. In particular, the canister vent valve may be an open that is closed upon actuation of the canister vent solenoid.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, a first fuel tank isolation valve 110 may be optionally included in conduit 31 a such that fuel tank 20 is coupled to canister 22 via the valve. During regular engine operation, first isolation valve 110 may be kept closed to limit the amount of diurnal or "running loss" vapors directed to canister 22 from fuel tank 20. During refueling operations, and selected purging conditions, first isolation valve 110 may be temporarily opened, e.g., for a duration, to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows first isolation valve 110 positioned along conduit 31*a*, in alternate embodiments, the isolation valve may be mounted on fuel tank 20, or along conduit 31.

Additionally, hybrid vehicle system 6 may be configured to operate with minimal intake manifold vacuum, to improve vehicle efficiency, for example. Under such conditions, even if the engine is on, there may be insufficient manifold vacuum to purge canister 22. To address this, a second fuel tank isolation valve 131 may be optionally included in conduit 31 such that fuel tank 20 is coupled directly to intake manifold 44 via the valve (as well as via purge valve 112). In this way, fuel tank vapor may be vented directly to intake under conditions where canister 22 is saturated (e.g. containing a concentration of hydrocarbon vapors above a threshold) but cannot be purged.

To further address canister purging, an ejector 130 may be coupled between conduit 31 and conduit 28, coupling the fuel tank to intake, as well as coupling both the fuel tank and intake to the canister. In this way, fuel vapor purged from the fuel tank directly to intake will pass through the ejector and draw a vacuum on canister 22, allowing the canister to be purged to intake, even if manifold vacuum is below a threshold necessary for traditional purging routines. A more detailed description of systems and methods for canister purging are discussed herein and depicted in FIGS. 2A-2C and FIG. 3.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 directly coupled to fuel tank 20, in alternate embodiments, the pressure sensor may be coupled between the fuel tank and canister 22, specifically between the fuel tank and first isolation valve 110. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. In some examples, a vehicle control system may infer and indicate a fuel system leak based on changes in a fuel tank pressure during a leak diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and canister 22.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open first isolation valve 110 and canister vent valve 114 while closing canister purge valve (CPV) 112 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open first isolation valve 110 and canister vent valve 114, while maintaining canister purge valve 112 closed, to depressurize the fuel tank before allowing enabling fuel to be added therein. As such, first isolation valve 110 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 12 may open canister purge valve 112 and canister vent valve while closing first isolation valve 110. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined. Further descriptions of purging routines are discussed herein and with regards to FIGS. 2A-2C and FIG. 3.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, pressure sensor 120, and pressure sensor 129. Other sensors such as additional pressure, temperature, air/fuel ratio, and composition sensors may be coupled to various locations in the vehicle system 6. As another example, the actuators may include fuel injector 66, first isolation valve 110, purge valve 112, vent valve 114, second isolation valve 131, fuel pump 21, and throttle 62.

Control system 14 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 14 may further be configured to receive information via the internet or other communication networks. Information received from the GPS may be cross-referenced to information available via the internet to determine local weather conditions, local vehicle regulations, etc. Control system 14 may use the internet to obtain updated software modules which may be stored in non-transitory memory.

The control system 14 may include a controller 12. Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines. An example control routine is described herein with regard to FIG. 3.

FIGS. 2A-2C show detailed schematic depictions of an evaporative emissions system 200 including fuel vapor canister 22 as well as the conduits and valves that act to couple canister 22 to atmosphere, engine intake, and the fuel tank as described herein and with regards to FIG. 1. In these schematics, open valves are depicted as open circles, closed valves are indicated by crossed circles, and the flow of fuel vapor and air are shown by dashed arrows. FIGS. 2A-2C depict canister 22 coupled to conduit 31 via conduit 31*a* and to ejector 130 via conduit 28*a*, but other conformations are possible without departing from the scope of this disclosure.

FIG. 2A shows evaporative emissions system 200 during a fuel tank venting routine, such as during a refueling operation. In this configuration, CPV 112 is closed, decoupling the fuel tank and fuel vapor canister 22 from engine intake. Second fuel tank isolation valve 131 is also closed. First fuel tank isolation valve 110 is open, allowing for fuel vapors to purge from the fuel tank to fuel vapor canister 22. Canister vent valve 114 is also open, allowing air stripped of fuel vapor by canister 22 to be vented to atmosphere via vent 27.

FIG. 2B shows evaporative emissions system 200 during a purge operation where engine manifold vacuum is sufficient to purge fuel vapor canister 22. In this configuration, first fuel tank isolation valve 110 and second fuel tank isolation valve 131 are both closed, decoupling the fuel tank from the fuel vapor canister and engine intake. CPV 112 is open, allowing for engine intake manifold vacuum to be applied to fuel vapor canister 22. CVV 114 is also open, allowing for fresh air to be drawn into canister 22 by the applied vacuum. In this way, fuel vapor may be desorbed from the adsorbent in canister 22, and directed to engine intake for combustion.

FIG. 2C shows evaporative emissions system 200 during a purge operation where engine manifold vacuum is insufficient to purge fuel vapor canister 22. In this configuration, first fuel tank isolation valve 110 is closed. CVV 114 is open, coupling canister 22 to atmosphere via vent 27. Second fuel tank isolation valve 131 and CPV 112 are both open, coupling the fuel tank to intake via ejector 130. This allows fuel vapor to be purged directly to intake via conduits 31 and 28. By placing ejector 130 as depicted, under conditions where fuel tank vapor pressure is above a threshold amount (e.g. 50 psi) venting the fuel tank vapor through the ejector yields enough vacuum to purge canister 22, even if manifold vacuum is insufficient for a purging operation.

If fuel tank vapor pressure is below the threshold for purging the fuel vapor canister, fuel tank vapor may still be purged to intake by opening second fuel tank isolation valve 131 and CPV 112, while closing first fuel tank isolation valve 110 and canister vent valve 114. Fuel tank vapor may also be purged to intake in this fashion under other conditions, such as if canister 22 and/or CVV 114 are malfunctioning.

FIG. 3 shows a high level flow chart for an example method 300 for purging a fuel vapor canister. Method 300 will be described with regards to the systems depicted in FIGS. 1 and 2A-2C, but it should be understood that similar methods may be used with other systems without departing from the scope of this disclosure. Method 300 may be carried out by controller 12.

Method 300 may begin at 310 by estimating operating conditions. Operating conditions may include ambient conditions, such as temperature, humidity, and barometric pressure, as well as vehicle conditions, such as engine operating status, fuel level, MAF, MAP, etc. Continuing at 320, method 300 may include determining whether the engine is on. In a non-hybrid vehicle, method 300 may not run when the engine is off. When implemented in a hybrid vehicle, method 300 may include determining the engine operating status, such as engine-only, battery-only, or a combination thereof.

If the engine is not on, method 300 may proceed to 325. At 325, method 300 may include maintaining the fuel system status. Maintaining the fuel system status may include maintaining valves, such as CPV 112 and CVV 114 in an open or closed position. Method 300 may then end.

If the engine is determined to be on at 320, method 300 may proceed to 330. At 330, method 300 may include determining whether the content of fuel vapor canister 22 is above a threshold. In other words, method 300 may include determining whether vapor canister 22 is saturated with hydrocarbon fuel vapor, and/or at or above a content level where purging is recommended. Determining whether the content of fuel vapor canister 22 is above a threshold may include determining a hydrocarbon percentage or oxygen percentage from a sensor coupled to canister 22, for example. In another example, controller 12 may determine a quantity of fuel vapor vented to canister 22 since the last purge event based on flow rates through first FTIV 110.

If the content of fuel vapor canister 22 is below the threshold, method 300 may proceed to 325, and maintain the fuel system status. Method 300 may then end. If the content of fuel vapor canister 22 is above a threshold, method 300 may proceed to 340.

At 340, method 300 may include determining whether intake manifold vacuum is above a threshold. In other words, method 300 may include determining whether there is sufficient manifold vacuum to purge canister 22. Determining whether intake manifold vacuum is above a threshold may include determining manifold vacuum levels via MAP sensor 118. Manifold vacuum level may be evaluated over a period of time and evaluated based on operating conditions to estimate future manifold vacuum levels (e.g. whether manifold vacuum is expected to increase, decrease, or stay relatively constant).

If manifold vacuum is determined to be above a threshold, method 300 may proceed to 342. At 342, method 300 may include closing first FTIV 110, and opening CPV 112, and further opening CVV 114. In some scenarios, CVV 114 may already be open. As such, CVV 114 would be maintained open. In this way, the fuel tank is decoupled from the fuel canister, and the fuel canister is coupled to intake and atmosphere, facilitating purging.

Continuing at 345, method 300 may include purging canister 22. Purging canister 22 may include maintaining the current valve status for a period of time. The period of time may be predetermined, or may be determined based on operating conditions, such as the manifold vacuum level and the content of canister 22. Continuing at 347, method 300 may include closing CPV 112 and CVV 114 following canister purging. Controller 12 may record the completion of a purging operation. Method 300 may then end.

If manifold vacuum is determined to be below a threshold at 340, method 300 may proceed to 350. At 350, method 300 may include determining whether fuel tank pressure is above a threshold. In other words, method 300 may include determining whether there is sufficient fuel vapor pressure in fuel tank 20 to mediate canister purging via ejector 130. For example, a fuel tank vapor threshold may be set at or above 50 psi, depending on the configuration of fuel system 18 and/or the amount of manifold vacuum available. Fuel tank pressure may be determined via fuel tank pressure sensor 120 or another suitable sensor. If fuel tank pressure is below the threshold to mediate canister purging, method 300 may proceed to 355. At 355, method 300 may include maintaining the fuel system status, and may also include indicating that a purge routine was aborted. Controller 12 may set a flag indicating to attempt a purge routine at a later time point, and/or may monitor manifold vacuum and fuel tank pressure until one or both respective thresholds are met. Method 300 may then end.

If fuel tank pressure is determined to be above a threshold, method 300 may proceed to 360. At 360, method 300 may include closing first FTIV 110, opening second FITV 131, opening CPV 112, and further opening CVV 114. In some scenarios, CVV 114 may already be open. As such, CVV 114 would be maintained open. In this way, the fuel tank is coupled to intake via ejector 130, drawing a vacuum on canister 22, and facilitating canister purging.

Continuing at 362, method 300 may include purging canister 22. Purging canister 22 may include maintaining the current valve status for a period of time. The period of time may be predetermined, or may be determined based on operating conditions, such as the manifold vacuum level and the content of canister 22. Continuing at 365, method 300 may include closing second FTIV 131, CPV 112, and CVV 114 following canister purging. Controller 12 may record the completion of a purging operation. Method 300 may then end.

The systems described herein and depicted in FIGS. 1 and 2A-2C, along with the method described herein and depicted in FIG. 3 may enable one or more systems and one or more methods. In one example, a method for purging fuel vapors, comprising: purging fuel tank vapors directly from a fuel tank to an engine intake, bypassing a canister, via a venturi, while drawing canister vapors via the venturi into the purged fuel tank vapors en route to the engine intake. The method may further comprise: closing a first fuel tank isolation valve coupled between the fuel tank and a fuel vapor canister; and opening a second fuel tank isolation valve coupled between the fuel tank and the venturi. The method may further comprise opening a canister vent valve and a canister purge valve. The venturi may be included in an ejector, the ejector coupled between the second fuel tank isolation valve and the canister purge valve. Purging fuel tank vapors directly from a fuel tank to an engine intake may include purging fuel tank vapors directly from a fuel tank to an engine intake when a fuel tank pressure is above a threshold. In some embodiments, purging fuel tank vapors directly from a fuel tank to an engine intake may include purging fuel tank vapors directly from a fuel tank to an engine intake when a manifold vacuum is below a threshold. In some embodiments, purging fuel tank vapors directly from a fuel tank to an engine intake may include purging fuel tank vapors directly from a fuel tank to an engine intake when a canister load level is above a threshold. The technical result of implementing this method is a reduction in bleed emissions from a fuel vapor canister. The method increased the frequency of purge opportunities, using fuel tank vapors to enable purging of a fuel vapor canister, even under conditions where there is insufficient manifold vacuum to enable a canister purge routine.

In another example, a system for an evaporative emissions system, comprising: a fuel tank coupled to a fuel vapor canister via a first fuel tank isolation valve; an ejector coupled to the fuel vapor canister and a second fuel tank isolation valve, the second fuel tank isolation valve configured to: responsive to a fuel tank pressure being above a threshold, enable fuel vapor to flow from the fuel tank through the ejector to an engine intake; and draw a vacuum on the fuel vapor canister. Drawing a vacuum on the fuel vapor canister may further include enabling fresh air flow into the fuel vapor canister via a vent under conditions where a canister vent valve is open. The second fuel tank isolation valve may be further configured to enable fuel vapor to flow from the fuel tank through the ejector to the engine intake responsive to a manifold vacuum being below a threshold. The second fuel tank isolation valve may be further configured to enable fuel vapor to flow from the fuel tank through the ejector to the engine intake responsive to an engine-on condition. The second fuel tank isolation valve may be further configured to enable fuel vapor to flow from the fuel tank through the ejector to the engine intake responsive to a canister load level being above a threshold. The system may further comprise a canister purge valve coupled between the ejector and the engine intake. The first fuel tank isolation valve may be configured to: responsive to a canister load level being below a threshold, enable fuel vapor to flow from the fuel tank to the fuel vapor canister. The technical result of implementing this system includes the generation of a vacuum for canister purging without adding any additional load to the engine. In this way, the system leverages fuel tank vapor pressure, which currently has no benefits, into generating a vacuum applied to a fuel vapor canister.

In yet another example, a method for purging a fuel vapor canister, comprising: during a first condition including a fuel tank pressure above a threshold, close a first fuel tank isolation valve, the first fuel tank isolation valve coupled between a fuel tank and a fuel vapor canister; open a second fuel tank isolation valve, the second fuel tank isolation valve coupled between the fuel tank, the fuel vapor canister, and an engine intake; and open a canister purge valve and canister vent valve. The first condition may further include an intake manifold vacuum below a threshold. Opening the second fuel tank isolation valve may direct fuel tank vapor through an ejector, the ejector configured to draw a vacuum on the fuel vapor canister. The first condition may further include a fuel vapor canister load level above a threshold. In some embodiments, the first condition may further include an engine-on condition. The method may further comprise: during a second condition, including an intake manifold vacuum above the threshold, close the first fuel tank isolation valve; open a canister purge valve and canister vent valve; and maintain the second fuel tank isolation valve closed. The technical result of implementing this method is an increase in engine efficiency, as a high intake vacuum is not required to purge the fuel vapor canister in order to comply with government regulations for evaporative emissions. In this way, fuel tank vapors may be purged directly to intake under some conditions, while drawing manifold vacuum is not required to purge the fuel vapor canister. An efficient, low intake vacuum may be maintained.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for purging fuel vapors, comprising:

purging fuel tank vapors directly from a fuel tank to an engine intake, bypassing a canister, via a venturi, while drawing canister vapors via the venturi into the fuel tank vapors being purged directly from the fuel tank and en route to the engine intake, a first fuel tank isolation valve coupled between the fuel tank and a fuel vapor canister, a second fuel tank isolation valve coupled between the fuel tank and the venturi, the venturi included in an ejector coupled between the second fuel tank isolation valve and the canister purge valve.

2. The method of claim 1, further comprising:

closing the first fuel tank isolation valve coupled between the fuel tank and a fuel vapor canister; and opening the second fuel tank isolation valve coupled between the fuel tank and the venturi.

3. The method of claim 2, further comprising:

opening the canister vent valve and the canister purge valve.

4. The method of claim 1, where purging fuel tank vapors directly from a fuel tank to an engine intake includes purging fuel tank vapors directly from a fuel tank to an engine intake when a fuel tank pressure is above a threshold.

5. The method of claim 4, where purging fuel tank vapors directly from a fuel tank to an engine intake includes purging fuel tank vapors directly from a fuel tank to an engine intake when a manifold vacuum is below a threshold.

6. The method of claim 5, where purging fuel tank vapors directly from a fuel tank to an engine intake includes purging fuel tank vapors directly from a fuel tank to an engine intake when a canister load level is above a threshold.

7. A system for an evaporative emissions system, comprising:

a fuel tank coupled to a fuel vapor canister via a first fuel tank isolation valve;

an ejector coupled downstream stream of a second fuel tank isolation valve, the second fuel tank isolation valve coupled between the fuel tank, the fuel vapor canister, and an engine intake, where the venturi is coupled between the second fuel tank isolation valve and a canister purge valve, the second fuel tank isolation valve configured to:

responsive to a fuel tank pressure being above a threshold, enable fuel vapor to flow from the fuel tank through the ejector to an engine intake; and draw a vacuum on the fuel vapor canister.

8. The system of claim 7, where drawing a vacuum on the fuel vapor canister further includes:

enabling fresh air flow into the fuel vapor canister via a vent under conditions where a canister vent valve is open.

9. The system of claim 7, where the second fuel tank isolation valve is further configured to:

enable fuel vapor to flow from the fuel tank through the ejector to the engine intake responsive to a manifold vacuum being below a threshold.

10. The system of claim 9, where the second fuel tank isolation valve is further configured to:

enable fuel vapor to flow from the fuel tank through the ejector to the engine intake responsive to an engine-on condition.

11. The system of claim 7, where the second fuel tank isolation valve is further configured to:

enable fuel vapor to flow from the fuel tank through the ejector to the engine intake responsive to a canister load level being above a threshold.

12. The system of claim 7, wherein the canister purge valve is coupled between the ejector and the engine intake.

13. The system of claim 7, where the first fuel tank isolation valve is configured to:

responsive to a canister load level being below a threshold, enable fuel vapor to flow from the fuel tank to the fuel vapor canister.

14. A method for purging a fuel vapor canister, comprising:

during a first condition including a fuel tank pressure above a threshold and an intake manifold vacuum below a threshold, closing a first fuel tank isolation valve, the first fuel tank isolation valve coupled between a fuel tank and a fuel vapor canister;

opening a second fuel tank isolation valve, the second fuel tank isolation valve coupled between the fuel tank, the fuel vapor canister, and an engine intake;

opening a canister purge valve and canister vent valve; and during a second condition, including an intake manifold vacuum above the threshold, closing the first fuel tank isolation valve;

opening a canister purge valve and canister vent valve; and maintaining the second fuel tank isolation valve closed.

15. The method of claim 14, where opening the second fuel tank isolation valve directs fuel tank vapor through an ejector, the ejector configured to draw a vacuum on the fuel vapor canister.

16. The method of claim 14, where the first condition further includes a fuel vapor canister load level above a threshold.

* * * * *